United States Patent [19]

Wall, Jr.

[11] Patent Number: 4,839,778

[45] Date of Patent: Jun. 13, 1989

[54] LOUVER SYSTEM

[75] Inventor: Alfred J. Wall, Jr., Lake Forest, Ill.

[73] Assignee: Louvenrs International, Wheeling, Ill.

[21] Appl. No.: 17,976

[22] Filed: Feb. 24, 1987

[51] Int. Cl.[4] ..... F21V 7/12

[52] U.S. Cl. ..... 362/150; 362/290; 362/342; 362/354; 362/325

[58] Field of Search ..... 362/290, 342, 354, 291, 362/292, 223, 325, 150

[56] References Cited

U.S. PATENT DOCUMENTS 4,272,804 6/1981 Blum ..... 362/150

FOREIGN PATENT DOCUMENTS 1211801 10/1959 France ..... 362/223
689000 4/1965 Italy ..... 362/354
2942560 5/1965 United Kingdom ..... 362/342

OTHER PUBLICATIONS

Potter, W. M. and Oetting R. L., Design and Illumination Characteristics of Louvre and Louvreall Systems, 1948, p. 14.

*Primary Examiner*—Ira S. Lazarus
*Assistant Examiner*—Sue Hagarman
*Attorney, Agent, or Firm*—Wood, Dalton, Phillips, Mason & Rowe

[57] ABSTRACT

A louver system for use with louver supports having inwardly opening perimetral end and side channel defining a rectangular louver space and adapted to receive the end and side edges of the louver. The louvers are provided with integrally molded end and side flanges, which may be of either of two preselected lengths, illustratively identified as short flanges and long flanges. The end flanges may have a length differing from the side flanges in the louver. Each of the short and long flanges may have different lengths depending on whether the cells of the louver are small or large. By providing the small cell louvers with either of the short or long flanges and the large cell louvers with either of the short or long flanges, a majority of standard louver mounting systems may be accommodated with only the four configurations.

36 Claims, 2 Drawing Sheets

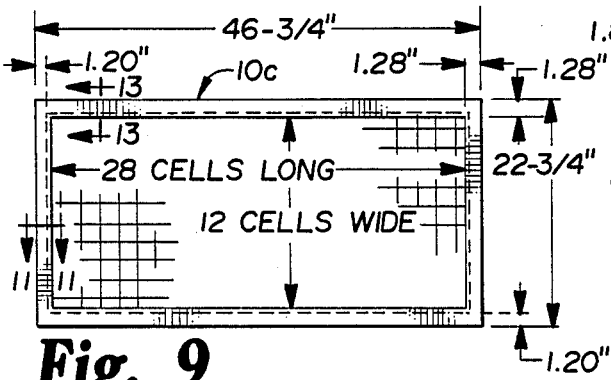
Fig. 9
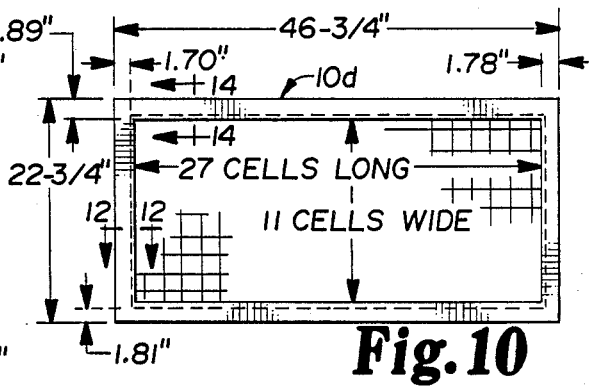
Fig. 10
Fig. 11
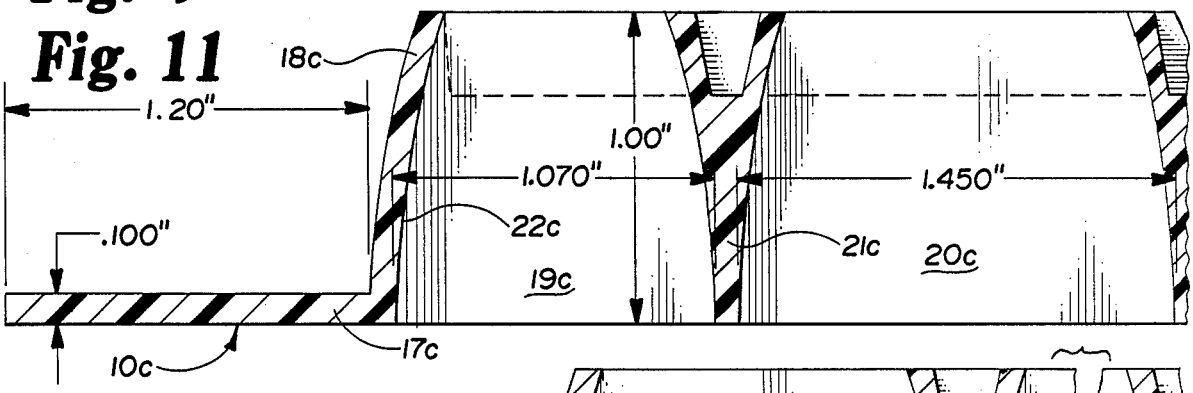
Fig. 12
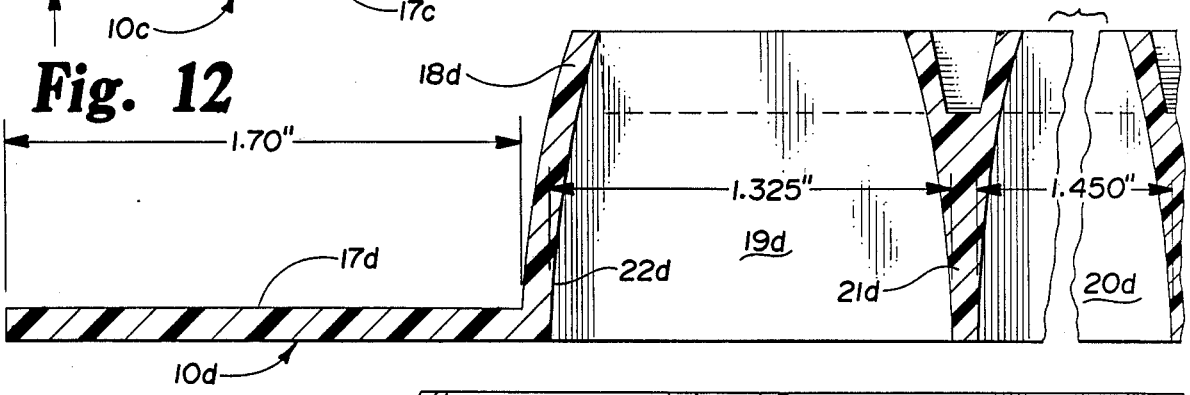
Fig. 13
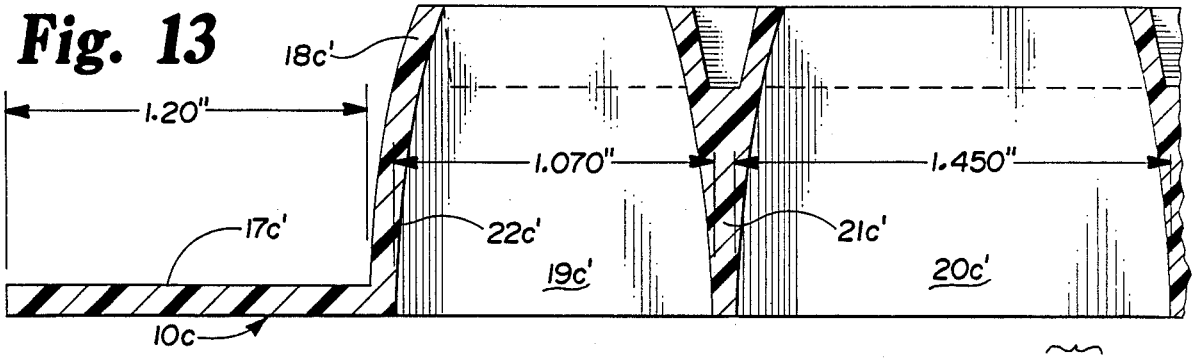
Fig. 14
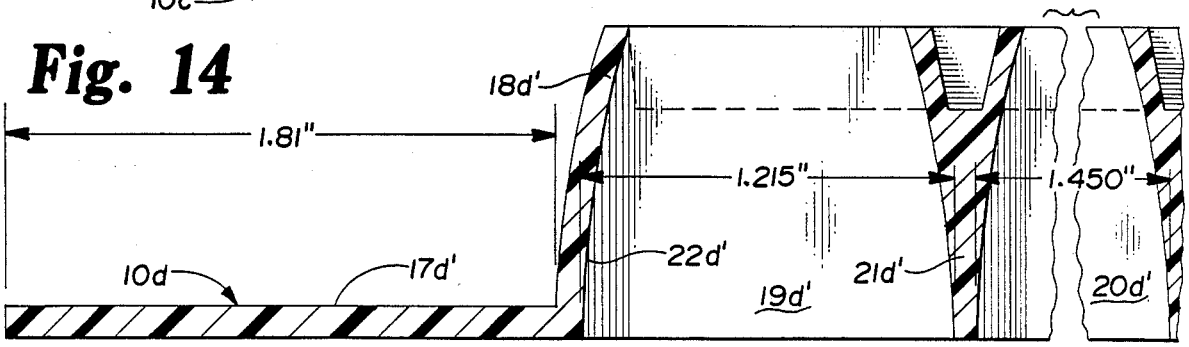

LOUVER SYSTEM

TECHNICAL FIELD

This invention relates to lighting fixtures and in particular to louvers for use therein.

BACKGROUND ART

In one well-known form of lighting fixture, a troffer is recessed in a ceiling and provided with a lowermost door or lens through which the light from the fluorescent bulbs installed therein passes in illuminating the space below.

It is conventional to provide in the door or lens frame, an inwardly opening peripheral channel for receiving the peripheral edges of the louver or lens. Heretofore, a large number of lens arrangements have been required for use with the different troffer configurations and utilizing the different louver cell configurations.

It has been conventional to provide louvers cells in either small opening form or large opening form. Thus, illustratively, a conventional configuration for a louver having small opening cells is one wherein the cells have a square cross section at the lower portion thereof of approximately 0.585" per side. In another form of such louvers utilizing relatively large open cells, the cells have a square cross section at the bottom portion thereof of approximately 1.450" per side.

It has been conventional to provide louvers with the edge cells thereof received in the channels of the doors or frames. Alternatively, flanged adapters may be provided to be mounted on the peripheral edges of the louver and define flange means for reception in the channels of the mounting structure.

In one known construction, the louver has been provided with an integral molded flange.

DISCLOSURE OF INVENTION

The present invention comprehends an improved louver system wherein each of the small and large size louver structures is provided alternatively with short or long flanges, whereby a small number of louver configurations is adapted for use with substantially all of the existing louver mounting structures.

More specifically, the invention comprehends the provision of a louver system for use with the louver mounting structures defining a louver space having a preselected length of approximately 46¾" and a preselected width of approximately 27¾". In a smaller square form, the mounting structure defines a louver space of approximately 20.350" per side.

The louver system comprises a plurality of louvers having open cells of either approximately 0.585" or 1.450" square.

In the louvers having the approximately 0.585" cells, at least one of the louvers is provided with end and side flanges adapted to be received in the end and side channels of the mounting structure, respectively, and having a width of approximately 1", at least one other of the plurality being provided with end and side flanges having a width of approximately 1½".

The louver system further includes a plurality of louvers having open cells approximately 1.450" square wherein at least one of the plurality is provided with end and side flanges having a width of approximately 1¼", and at least one of the plurality is provided with end and side flanges having a width of approximately 1¾".

More specifically, the invention comprehends a provision of such a louver system wherein the louvers having cells of approximately 0.585" square configuration have end flanges of either 1.062" or 1.44" and side flanges of either 1.1" or 1.562", respectively.

The invention further comprehends the provision in a louver system wherein the louvers have large open cells of approximately 1.450" square, at least one louver having end flanges having a width of approximately 1.2", and at least one other louver having end flanges of approximately 1.7".

The invention further comprehends the provision in such a large cell louver of at least one louver of the system having side flanges having a width of approximately 1.2" and at least one other louver of the system having side flanges having a width of approximately 1.81".

Still further, the invention comprehends the provision in such a louver system having large cells of at least one louver having cells adjacent the end flanges having a width of approximately 1.070" and at least one other louver having cells adjacent the end flanges having a width of approximately 1.325".

Still further, the invention comprehends the provision in such louvers having large cells of cell adjacent the side flanges having a width of approximately 1.070" and, in at least one other louver of the plurality, having cells adjacent the side flanges having a width of approximately 1.215".

The louver system of the present invention is extremely simple and economical of construction, while yet providing a highly improved, low cost louver system facilitating manufacture and replacement of the louvers.

BRIEF DESCRIPTION OF THE DRAWING

Other features and advantages of the invention will be apparent from the following description taken in connection with the accompanying drawing wherein:

FIG. 9 is a plan view of another form of louver having large cells provided with narrow end and side flanges embodying the invention;

FIG. 10 is a plan view of still another form of louver having large cells provided with wide end and side flanges embodying the invention;

FIG. 11 is a fragmentary enlarged vertical section taken substantially along the line 11—11 of FIG. 9;

FIG. 12 is a fragmentary enlarged vertical section taken substantially along the line 12—12 of FIG. 10;

FIG. 13 is a fragmentary enlarged vertical section taken substantially along the line 13—13 of FIG. 9; and FIG. 14 is a fragmentary enlarged vertical section taken substantially along the line 14—14 of FIG. 10;

BEST MODE FOR CARRYING OUT THE INVENTION

Figure 1:
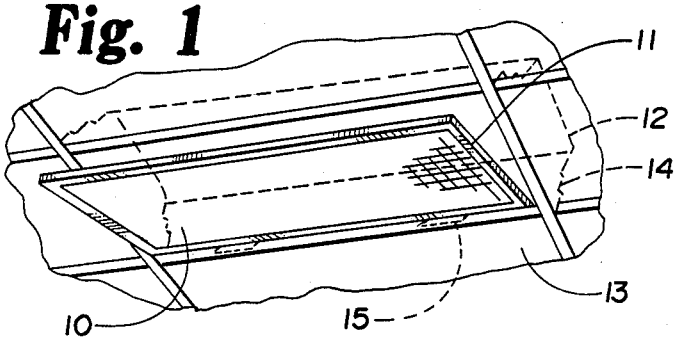
FIG. 1 is a perspective view illustrating the installation of a troffer in a ceiling adapted for receiving a louver of the louver system embodying the invention.

In the illustrative embodiment of the invention as disclosed in the drawing, a louver system is shown to comprise a plurality of different louvers generally designated 10 selectively installed in a frame 11 of a troffer generally designated 12. The troffer, in the illustrated embodiment, is recessed in a ceiling 13. The frame 11 may comprise a door, as shown in FIG. 1, which may be swingably connected to the troffer shell 14 by suitable hinges 15.

Figure 2:
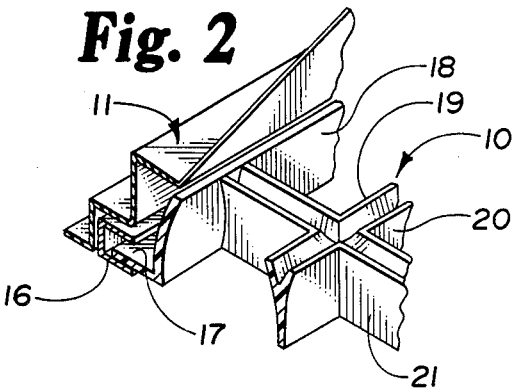
FIG. 2 is a fragmentary perspective illustrating the reception of the louver flange in the inwardly opening channel of the troffer mounting means.
Figure 3:
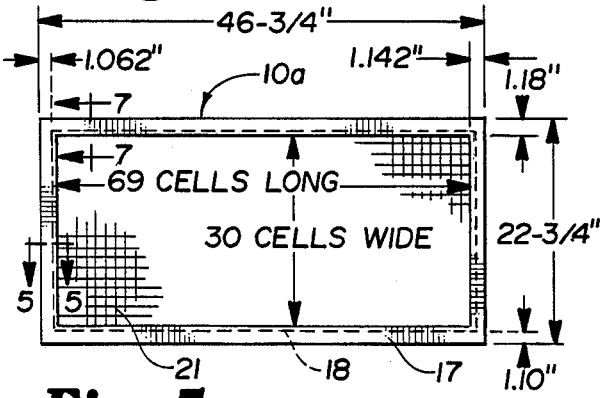
FIG. 3 is a plan view of a louver embodying the invention having relatively small cell openings and narrow end and side flanges embodying the invention.
Figure 4:
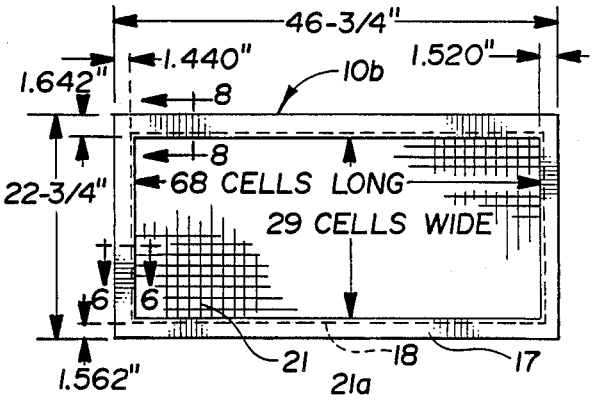
FIG. 4 is a plan view illustrating another form of louver having small cells and wide end and side flanges embodying the invention.

As shown in FIG. 2, the frame 11 includes an inwardly opening peripheral channel 16 adapted to receive outwardly extending flanges 17 of the louver 10. The louver may be formed as by molding from synthetic resin, with the flanges being molded integrally therewith to extend outwardly from the peripheral edge wall 18 of the louver. The louver defines peripheral cells 19 adajcent the outer wall 18 and inner cells 20 intermediate the peripheral cells. The intermediate cells are defined by V-shaped upright intersecting walls 21. The cells widen downwardly, being defined by parabolic faces 22.

The sidewalls 18 illustratively have thickness of approximately 0.08", and the lowermost portion of the divider walls 21 illustratively may have a thickness of 0.04" to 0.05".

The flange 17 may have a thickness of approximately 1.00".

The invention is more specifically concerned with the width of the flange outwardly from the sidewall 18. More specifically, the invention is directed to the provision of louvers having either of two different width flanges in such louvers having relatively large cells and two different width flanges in such louvers having relatively narrow cells, whereby the louver system is adapted for use with conventional mounting supports defining a louver space which is conventionally approximately 20" wide. The space illustratively may have a length of approximately 20" in a square form and approximately 44" in a rectangular form.

Such louvers are conventionally provided with open cells of either large or small cross-sectional area. In the small cell form, the cells have a square cross section approximately 0.625" center to center (including the thickness of the divider wall); and openings approximately 0.585" per side, and in the large cell form, the cells have a square cross section approximately 1.5" center to center (including the thickness of the divider wall); and openings approximately 1.450" per side. Thus, the small cells are approximately ½" square whereas the large cells are approximately 1½" square. The peripheral cells, i.e. the cells adjacent the flanges may have a dimension in the direction of the flanges or less than that of the middle cells.

Figure 5:
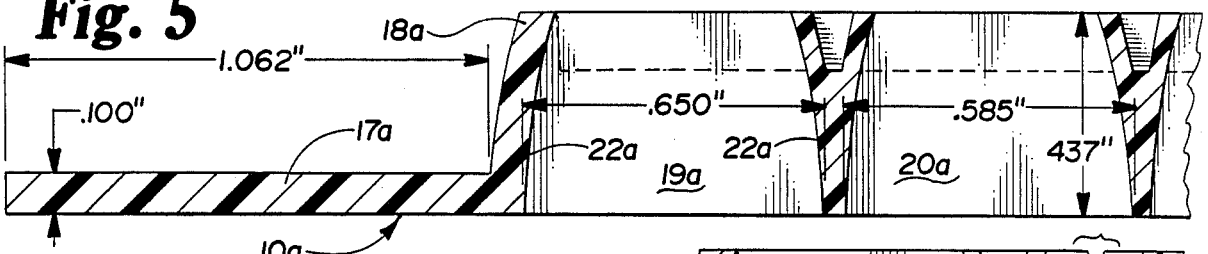
FIG. 5 is a fragmentary enlarged vertical transverse section taken substantially along the line 5—5 of FIG. 3.
Figure 6:
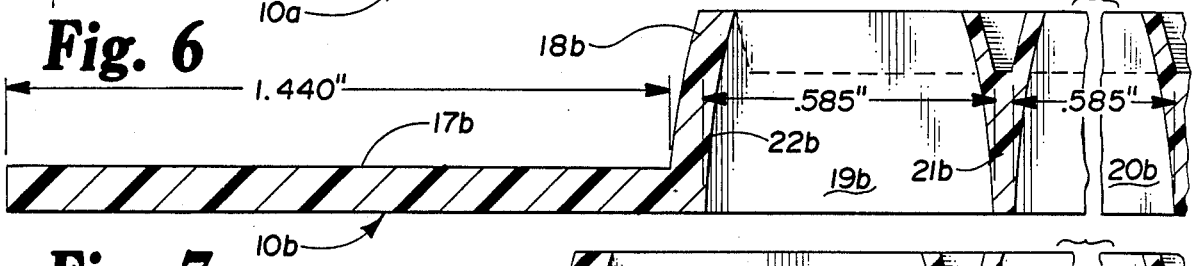
FIG. 6 is a fragmentary enlarged vertical section taken substantially along the line 6—6 of FIG. 4.

Illustratively, in the small cell louvers, **10*a* and 10*b* illustrated in FIGS. 3–8, the flanges 17 may be either short or long, as illustrated in FIGS. 5 through 8. In the form of louver having the relatively small cross section cells, the short flanges 17*a* at the opposite ends of the louver 10*a*, as shown in FIG. 5, may have a length of approximately 1.062" and the adjacent cells 19*a* may have a width of approximately 0.650". In such louvers utilizing the long flange, as illustrated in FIG. 6, the flange 17*b* may have a length of 1.440" and the end cells 19*b*** may have a width of approximately 0.585". Thus, the width of the long flanges is approximately 1½ times the width of the short flanges, i.e. 1.440"/1.062" and 1.562"/1.100".

Figure 7:
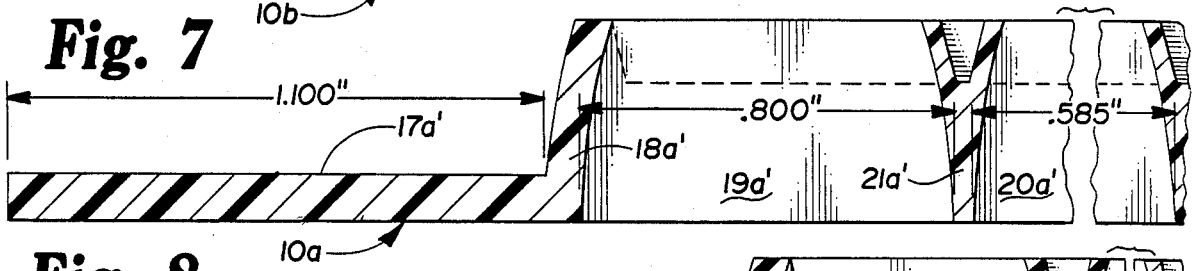
FIG. 7 is a fragmentary enlarged vertical section taken substantially along the line 7—7 of FIG. 3.
Figure 8:
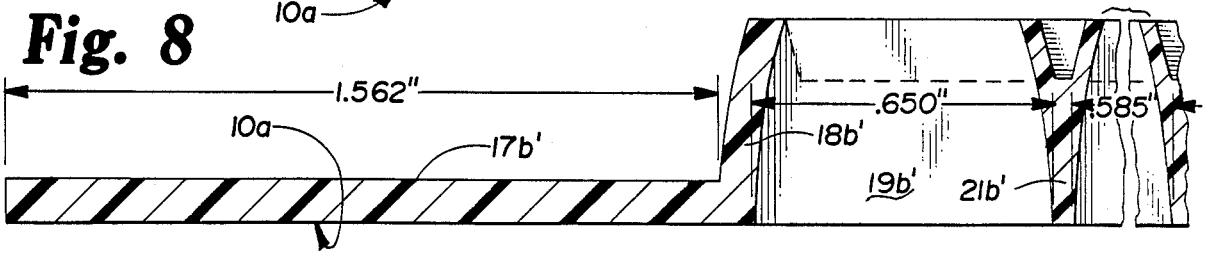
FIG. 8 is a fragmentary enlarged vertical section taken substantially along the line 8—8 of FIG. 4.

As illustrated in FIGS. 7 and 8, the side flanges **17*a*' of such louvers may have a length of approximately 1.10" in the short form, with the adjacent side cells 19*a*' having a length of approximately 0.800", and in the form utilizing the long flange, the side flanges 17*b*' may have a length of approximately 1.562", with the adjacent cells 19*b*'** having a length of approximately 0.650".

Referring now to the embodiment of FIGS. 9–14, where the louvers **10*c* and 10*d* are provided with relatively large cross section cells, the short end flanges 10*c* may have a length of approximately 1.20" and the adjacent cells 19*c* may have a corresponding length of approximately 1.070". The long end flanges 17*d*, in such a louver 10*b*, may have a length of approximately 1.70", with the adjacent cells 19*d*** having a length of approximately 1.325".

The short side flanges **17*c*', in such a large cell louver 10*c*, may have a length of approximately 120", with the adjacent cells 19*c*' having a length of approximately 1.070", and the long flanges 17*d*' may have a length of approximately 1.81", with the adjacent cells 19*d*'** having a length of approximately 1.215". Thus, the width of the long flanges is approximately 1½ times the width of the short flanges, i.e. 1.70"/1.20" and 1.80"/1.20".

The height of the small cell louvers **10*a* and 10*b*, as seen in FIGS. 5 through 8, may be approximately 0.437", and the height of the louvers 10*c* and 10*d* having the relatively large cells may be approximately 1.00", as shown in FIGS. 11 through 14**.

As further illustrated in the drawing, the number of cells may be one less in each of the length and width directions where the long flanges are provided, and similarly, may be one less in each of the length and width directions where the large cells are provided.

Thus, in the illustrated small cell louvers **10*a* and 10*b*, the cell arrangement may comprise 69 cells in length by 30 cells in width where the short flanges 17*a* and 17*a*' are utilized, and 68 cells in length and 29 cells in width where the long flanges 17*b* and 17*b*'** are utilized.

Further illustratively, the louvers **10*c* and 10*d* of the present invention may comprise 28 cells in length and 12 cells in width where the short flanges 17*c* and 17*c*' are utilized, and 27 cells in length and 11 cells in width where the long flanges 17*d* and 17*d*'** are utilized.

Thus, briefly, the invention comprehends the provision of such a louver system comprising a plurality of louvers having open cells approximately 1.5" square, with at least one of the plurality of louvers having end and side flanges having a length of approximately 1¼", and at least one other of the plurality having end and side flanges of approximately 1¾". By utilizing two different size flange widths, it has been found possible to provide louvers for accommodation to at least approximately 90% of all commercially available louver mounting means, thereby providing facilitated stocking and manufacturing.

The louvers may be manufactured economically by molding from synthetic resins for further minimizing of cost and facilitated stocking.

In the relatively small cell form of the louver wherein the cells are approximately ½" square, the length of the flanges in the louvers having short flanges is approximately 1", e.g. 1.062" flanges 17*a* and 1.100" flanges 17*a'* and the length of the louvers having long flanges is approximately 1½", e.g. 1.440" flanges 17*b* and 1.562" flanges 17*b'*. Where the louvers are provided with relatively large cells of approximately 1.5" square section, the short flanges have a length of approximately 1¼", e.g. 1.20" flanges 17*c* and 17*c'* and the long flanges have a length of approximately 1¾", e.g. 1.70" flanges 17*d* and 1.81" flanges 17*d'*.

The foregoing disclosure of specific embodiments is illustrative of the broad inventive concepts comprehended by the invention.

I claim:

1. A louver system for use with lower supports having inwardly opening perimetral end and side channels defining a rectangular louver space having a preselected length and a preselected width, said louver system comprising a plurality of louvers having open cells, at least one of which plurality of louvers is provided with end and side flanges adapted to be received in the end and side channels respectively of such a louver support and having a first width, and at least one other of which plurality of louvers is provided with end and side flanges adapted to be received in the end and side channels respectively of such a louver support and having a second width of approximately 1½ times said first width.

2. The louver system of claim 1 wherein said end flanges of said one louver have a width of approximately 1.062".

3. The louver system of claim 1 wherein said end flanges of said other one of said louvers have a width of approximately 1.44".

4. The louver system of claim 1 wherein said side flanges of said one louver have a width of approximately 1.1".

5. The louver system of claim 1 wherein said side flanges of said other one of said louvers have a width of approximately 1.562".

6. The louver system of claim 1 wherein cells adjacent the end flanges of said one louver have a width of approximately 0.650".

7. The louver system of claim 1 wherein cells adjacent the end flanges of said other one of said louvers have a width of approximately 0.585".

8. The louver system of claim 1 wherein the cells adjacent the side flanges of said one louver have a width of approximately 0.80".

9. The louver system of claim 1 wherein the cells adjacent the side flanges of said other one of said louvers have a width of approximately 0.650".

10. A louver system for use with louver supports having inwardly opening perimetral end and side channels defining a rectangular louver space having a preselected length and a preselected width, said louver system comprising a plurality of louvers having open cells approximately 1½" square, at least one of which plurality of louvers is provided with end and side flanges adapted to be received in the end and side channels respectively of such a louver support and having a width of approximately 1¼", and at least one other of which plurality of louvers is provided with end and side flanges adapted to be received in the end and side channels respectively of such a louver support and having a width of approximately 1¾".

11. The louver system of claim 10 wherein said end flanges of said one louver have a width of approximately 1.2".

12. The louver system of claim 10 wherein said end flanges of said other one of said louvers have a width of approximately 1.7".

13. The louver system of claim 10 wherein said side flanges of said one louver have a width of approximately 1.2".

14. The louver system of claim 10 wherein said side flanges of said other one of said louvers have a width of approximately 1.81".

15. The louver system of claim 10 wherein cells adjacent the end flanges of said one louver have a width of approximately 1.070".

16. The louver system of claim 10 wherein cells adjacent the end flanges of said other one of said louvers have a width of approximately 1.325".

17. The louver system of claim 10 wherein the cells adjacent the side flanges of said one louver have a width of approximately 1.070".

18. The louver system of claim 10 wherein the cells adjacent the side flanges of said other one of said louvers have a width of approximately 1.215".

19. A louver system for use with louver supports having inwardly opening perimetral end and side channels defining a rectangular louver space having a preselected length and a preselected width, said louver system comprising a plurality of louvers having open cells approximately ½" square, at least one of which plurality of louvers is provided with end and side flanges adapted to be received in the end and side channels respectively of such a louver support and having a width of approximately 1" and at least one other of which plurality of louvers is provided with end and side flanges adapted to be received in the end and side channels respectively of such a louver support and having a width of approximately 1½".

20. The louver system of claim 19 wherein said end flanges of said one louver have a width of approximately 1.062".

21. The louver system of claim 19 wherein said end flanges of said other one of said louvers have a width of approximately 1.44".

22. The louver system of claim 19 wherein said side flanges of said one louver have a width of approximately 1.10".

23. The louver system of claim 19 wherein said side flanges of said other one of said louvers have a width of approximately 1.56".

24. The louver system of claim 19 wherein cells adjacent the end flanges of said one louver have a width of approximately 0.650".

25. The louver system of claim 19 wherein cells adjacent the end flanges of said other one of said louvers have a width of approximately 0.585".

26. The louver system of claim 19 wherein the cells adjacent the side flanges of said one louver have a width of approximately 0.80".

27. The louver system of claim 19 wherein the cells adjacent the side flanges of said other one of said louvers have a width of approximately 0.650".

28. A louver system for use with louver supports having inwardly opening perimetral end and side channels defining a rectangular louver space having a preselected length and a preselected width, said louver system comprising a plurality of louvers having open cells, at least one of which plurality of louvers is provided with end and side flanges adapted to be received in the end and side channels respectively of such a louver support and having a first preselected width, and at least one other of which plurality of louvers is provided with end and side flanges adapted to be received in the end and side channels respectively of such a louver support and having a width a preselected amount larger than said preselected width.

29. The louver system of claim 1 wherein said end flanges of said one louver have a width of approximately 1.2".

30. The louver system of claim 1 wherein said end flanges of said other one of said louvers have a width of approximately 1.7".

31. The louver system of claim 1 wherein said side flanges of said one louver have a width of approximately 1.2".

32. The louver system of claim 1 wherein said side flanges of said other one of said louvers have a width of approximately 1.81".

33. The louver system of claim 1 wherein cells adjacent the end flanges of said one louver have a width of approximately 1.070".

34. The louver system of claim 1 wherein cells adjacent the end flanges of said other one of said louvers have a width of approximately 1.325".

35. The louver system of claim 1 wherein the cells adjacent the side flanges of said one louver have a width of approximately 1.070".

36. The louver system of claim 1 wherein the cells adjacent the side flanges of said other one of said louvers have a width of approximately 1.215".

* * * * *